US011992784B2

(12) United States Patent
Fakonas

(10) Patent No.: US 11,992,784 B2
(45) Date of Patent: May 28, 2024

(54) TOY STORAGE APPARATUS

(71) Applicant: Hasbro, Inc., Pawtucket, RI (US)

(72) Inventor: Katherine Alexandra Fakonas, East Walpole, MA (US)

(73) Assignee: Hasbro, Inc., Pawtucket, RI (US)

( * ) Notice: Subject to any disclaimer, the term of this patent is extended or adjusted under 35 U.S.C. 154(b) by 175 days.

(21) Appl. No.: 17/437,623

(22) PCT Filed: Mar. 18, 2020

(86) PCT No.: PCT/US2020/023335
§ 371 (c)(1),
(2) Date: Sep. 9, 2021

(87) PCT Pub. No.: WO2020/197884
PCT Pub. Date: Oct. 1, 2020

(65) Prior Publication Data

US 2022/0161150 A1 May 26, 2022

Related U.S. Application Data

(60) Provisional application No. 62/823,705, filed on Mar. 26, 2019.

(51) Int. Cl.
*A63H 33/00* (2006.01)
*A63H 33/22* (2006.01)

(52) U.S. Cl.
CPC ..... *A63H 33/001* (2013.01)

(58) Field of Classification Search
CPC ..... A63H 33/00; A63H 33/001; A63H 3/005; A63H 3/50; Y10S 425/057
(Continued)

(56) References Cited

U.S. PATENT DOCUMENTS 3,303,953 A * 2/1967 Frank ..... B65D 41/0492 215/390
3,590,749 A * 7/1971 Burns ..... A63H 33/001 425/173

(Continued)

FOREIGN PATENT DOCUMENTS

JP 2006115941 A 5/2006
JP 2011001098 A 1/2011
JP 3180767 U 1/2013

OTHER PUBLICATIONS

Bahng Seung Hoon, Korean Intellectual Property Office, International Search Report and Written Opinion, corresponding PCT Application No. PCT/US2020/023335, dated Jul. 13, 2020, 13 pages total.

*Primary Examiner* — Alexander R Niconovich
(74) *Attorney, Agent, or Firm* — DiBerardino McGovern IP Group LLC

(57) ABSTRACT

A toy set includes a first canister configured to hold a first amount of moldable material; a second canister configured to hold a second amount of moldable material; one or more pre-formed design elements; and a storage apparatus configured to hold the first canister and the second canister, the storage apparatus including: a first storage component including a structure that defines an opening that extends in a first direction, the structure being configured to hold one of the at least one pre-formed design elements or the first canister in the opening; and a second storage component including a base portion that extends along a second direction that is different from the first direction, the base portion including an interface configured to hold the second canister.

26 Claims, 5 Drawing Sheets

(58) Field of Classification Search
USPC ..... 446/71, 73, 75, 76, 77; 215/228
See application file for complete search history.

(56) References Cited

U.S. PATENT DOCUMENTS

| | | | | | |
|---|---|---|---|---|---|
| 4,215,843 | A * | 8/1980 | Gay | A63H 33/001 | 249/117 |
| 4,262,442 | A * | 4/1981 | Mansfield | A63H 33/001 | 425/DIG. 57 |
| 5,139,453 | A * | 8/1992 | Aiken | G09B 19/00 | 434/259 |
| 5,297,980 | A * | 3/1994 | Barthold | A63H 33/30 | 604/38 |
| 5,480,044 | A * | 1/1996 | Nosser | B65D 35/44 | 220/376 |
| 5,503,274 | A * | 4/1996 | Toffler | A63H 3/50 | D9/608 |
| 5,540,611 | A * | 7/1996 | Lapoint | B65D 81/366 | 446/72 |
| 5,954,561 | A * | 9/1999 | Cannone | A63H 33/3055 | 446/481 |
| 6,079,586 | A * | 6/2000 | Hanneman | B65D 81/3283 | 206/217 |
| 6,296,540 | B1 * | 10/2001 | LaPlaca | A63H 23/00 | 446/76 |
| 6,458,006 | B1 * | 10/2002 | Westbrook | B65D 51/24 | 81/3.15 |
| D507,180 | S | 7/2005 | Hina | | |
| D596,363 | S | 7/2009 | Wolford et al. | | |
| D602,355 | S | 10/2009 | Waaland | | |
| 7,784,635 | B2 * | 8/2010 | Luburic | B65D 1/24 | 220/525 |
| D635,421 | S | 4/2011 | Wegener et al. | | |
| D677,980 | S | 3/2013 | Levin | | |
| 8,701,907 | B1 * | 4/2014 | Mallicoat | B65D 51/245 | 81/3.4 |
| 8,720,714 | B2 * | 5/2014 | Romero | B67B 7/18 | 215/304 |
| D721,534 | S | 1/2015 | Rudisill et al. | | |
| D721,579 | S | 1/2015 | Ott | | |
| D722,247 | S | 2/2015 | Rudisill et al. | | |
| D722,248 | S | 2/2015 | Rudisill et al. | | |
| 9,387,962 | B2 * | 7/2016 | Mercado | A47G 19/06 | |
| 9,505,534 | B2 * | 11/2016 | Mercado | B65D 51/228 | |
| D808,805 | S | 1/2018 | Obata | | |
| 10,081,528 | B2 * | 9/2018 | Romero | B67B 7/403 | |
| D834,415 | S | 11/2018 | Luther | | |
| D834,416 | S | 11/2018 | Luther | | |
| D834,417 | S | 11/2018 | Luther | | |
| D834,418 | S | 11/2018 | Luther | | |
| 10,220,324 | B1 * | 3/2019 | Shoaff | A63H 3/005 | |
| 10,232,278 | B2 * | 3/2019 | Suzuki | C08K 3/08 | |
| 10,654,016 | B2 * | 5/2020 | Alber | B01F 23/511 | |
| 10,751,633 | B2 * | 8/2020 | Goodrich | A63H 9/00 | |
| 11,285,397 | B2 * | 3/2022 | Penney | A63H 33/001 | |
| 11,389,740 | B2 * | 7/2022 | Casino | A63H 33/001 | |
| 11,420,133 | B2 * | 8/2022 | Loik | A63H 33/32 | |
| 11,420,169 | B2 * | 8/2022 | Alber | B01F 35/3202 | |
| 2005/0268576 | A1 * | 12/2005 | Petrigac-Botson | B65D 83/0805 | 53/473 |
| 2008/0041861 | A1 * | 2/2008 | Crawford | B65B 31/00 | 220/697 |
| 2010/0212458 | A1 * | 8/2010 | Wegener | B67B 7/16 | 81/3.55 |
| 2017/0225087 | A1 * | 8/2017 | Galgana | A63H 3/50 | |
| 2020/0016505 | A1 * | 1/2020 | Adler | A63H 33/001 | |
| 2023/0211252 | A1 * | 7/2023 | Robbins | A63H 33/001 | 446/86 |

* cited by examiner

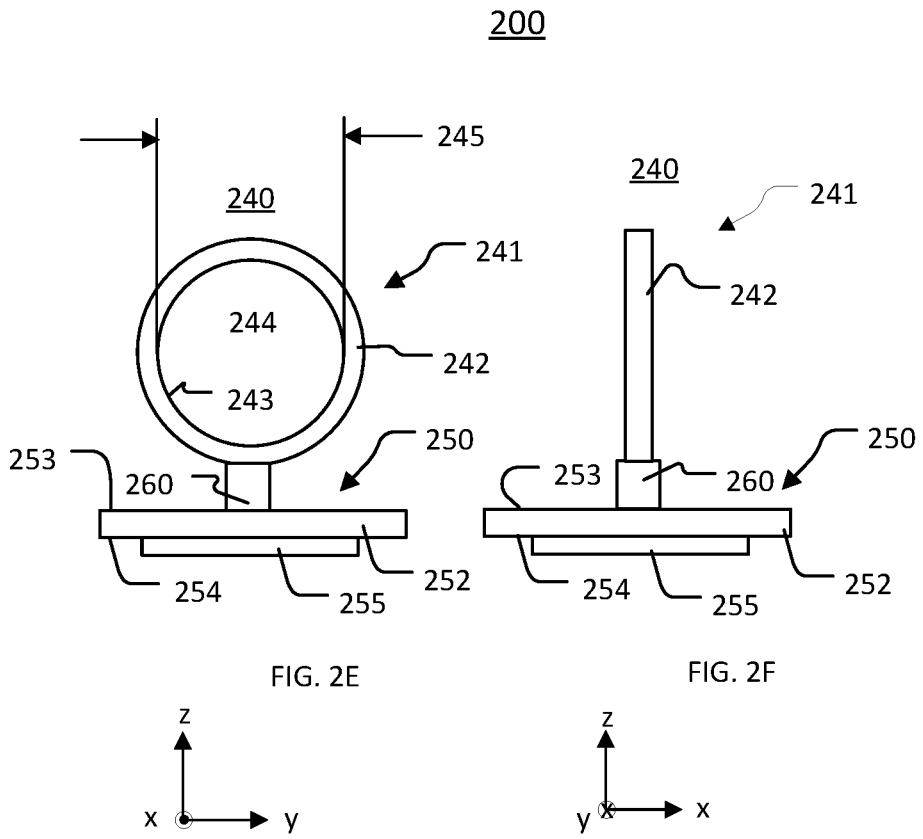
FIG. 2E
FIG. 2F
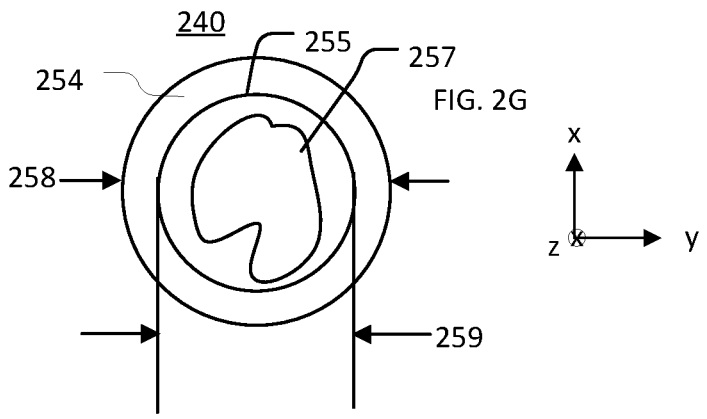
FIG. 2G

TOY STORAGE APPARATUS

CROSS-REFERENCE TO RELATED APPLICATION

This application claims the benefit of U.S. Provisional Application No. 62/823,705, filed on Mar. 26, 2019, and titled TOY STORAGE APPARATUS, which is incorporated herein by reference in its entirety.

TECHNICAL FIELD

This disclosure relates to a toy storage apparatus that may be included in a toy set.

BACKGROUND

Persons of all ages enjoy playing and interacting with toys.

SUMMARY

In one aspect, a toy set includes: a first canister configured to hold a first amount of moldable material; a second canister configured to hold a second amount of moldable material; one or more pre-formed design elements; and a storage apparatus configured to hold the first canister and the second canister, the storage apparatus including: a first storage component including a structure that defines an opening that extends in a first direction, the structure being configured to hold one of the at least one pre-formed design elements or the first canister in the opening; and a second storage component including a base portion that extends along a second direction that is different from the first direction, the base portion including an interface configured to hold the second canister.

Implementations may include one or more of the following features. The base portion may include a first side; a second side opposite the first side; and a flange that extends from the second side. The flange is configured to hold the second canister. The toy set also may include a second lid configured to attach to the second canister, and the second lid may include a recessed region, and the flange may be configured to fit into a recess of the second lid.

The first amount of moldable material may be different from the second amount of moldable material.

The first direction may be perpendicular to the second direction.

In some implementations, the toy set also include a first lid configured to attach to the first canister, and a second lid configured to attach to the second canister. In these implementations, the first lid has a first diameter, and the second lid has a second diameter that is different from the first diameter.

The toy set also may include a first lid configured to attach to the first canister, and the opening of the first storage component may hold the first canister at a perimeter of the first lid.

The base portion also may include a rigid projection that extends from the base portion. The rigid projection is surrounded by the interface. The interface may include a flange, the flange may extend in the first direction to a first distance from the first side of the base portion, the projection may extend in the first direction to a second distance from the first side of the base portion, the second distance may be less than the first distance such that, when the first side of the base portion is pressed into the moldable material, an imprinted element having substantially the same size as a region defined by the flange and a design that corresponds to the projection is formed.

The opening may be a circular opening.

In some implementations, the toy set also includes a creation block that includes a design projection extending from the first block side. The creation block may be configured to fit in the first canister.

The first direction may be perpendicular to the second direction, the first canister may extend along the second direction when the first canister is held by the structure, and the second canister may extend along the first direction when the interface holds the second canister.

The storage apparatus also may include a pedestal portion that extends in the first direction, the pedestal portion being connected to the first storage component and the second storage component. The first storage component, the second storage component, and the pedestal portion may be a single piece of molded plastic.

In some implementations, the toy set also includes a first lid configured to attach to the first canister, and a second lid configured to attach to the second canister. In these implementations, one or more of the first lid and the second lid includes a design projection.

The design element may include the moldable material.

In another aspect, a toy storage apparatus includes a first storage component including a structure that defines an opening that extends in a first direction, the structure being configured to hold a first canister at the opening, the first canister being configured to contain a modeling component in the opening; and a second storage component including a base portion that extends along a second direction that is different from the first direction, the base portion including an interface configured to hold a second canister.

Implementations may include one or more of the following features. The toy storage apparatus also may include a pedestal portion that extends in the first direction, the pedestal portion being connected to the first storage component and the second storage component.

The interface may include a flange, and the flange is configured to hold the second canister.

The toy storage apparatus also may include a design projection that extends from the base portion.

In another aspect, a toy set includes: a first canister configured to hold a moldable material; a second canister configured to hold a moldable material; a storage apparatus configured to hold the first canister and the second canister, the storage apparatus including: a first storage component including a structure that defines an opening that extends along a first direction and is configured to hold the first canister; and a second storage component including a base portion that extends along a second direction that is different than the first direction, the base portion including an interface configured to hold a second canister. The toy set also may include one or more pre-formed design elements configured to fit into the opening. The pre-formed design elements also may include the moldable material.

The toy set also may a creation block configure to fit into an interior of the first canister, the creation block including a design projection configured to impart a design onto the moldable material.

Implementations of any of the techniques described above can include a toy system, a toy storage apparatus, a method of using a toy set and/or components of a toy set, or a toy storage system. The details of one or more implementations are set forth in the accompanying drawings and the description below. Other features will be apparent from the description and drawings, and from the claims.

DRAWING DESCRIPTION

FIG. 2E is a block diagram of another toy storage apparatus.

FIG. 2F is a side view of the toy storage apparatus of FIG. 2E.

FIG. 2G is a bottom view of the toy storage apparatus of FIG. 2E.

DESCRIPTION

Figure 1A:
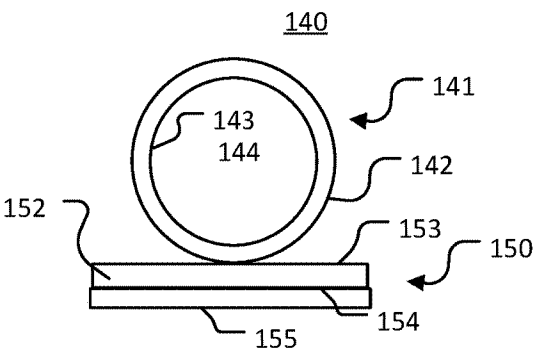
FIG. 1A is a block diagram of a toy storage apparatus.
Figure 1B:
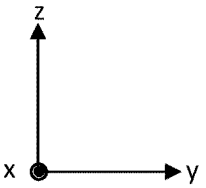
FIG. 1B is a block diagram of a toy system that includes the toy storage apparatus of FIG. 1A.
Figure 1B:
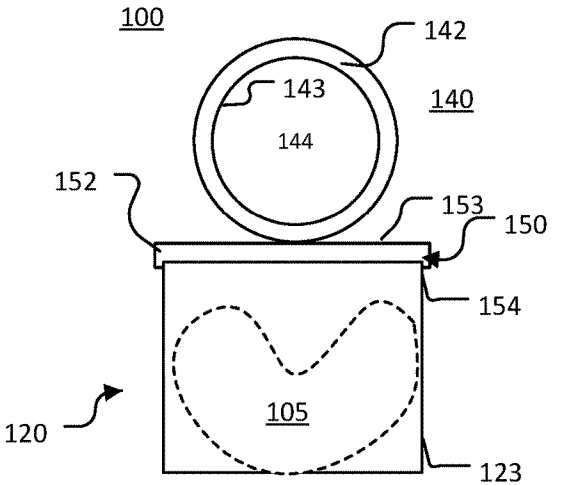
Figure 1C:
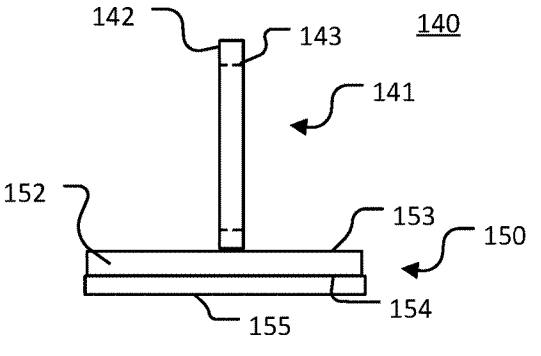
FIG. 1C is a side view of the toy storage apparatus of FIG. 1A.
Figure 1D:
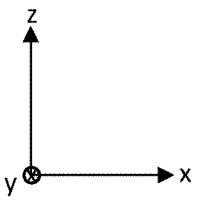
FIG. 1D is a side view of the toy system of FIG. 1B.
Figure 1D:
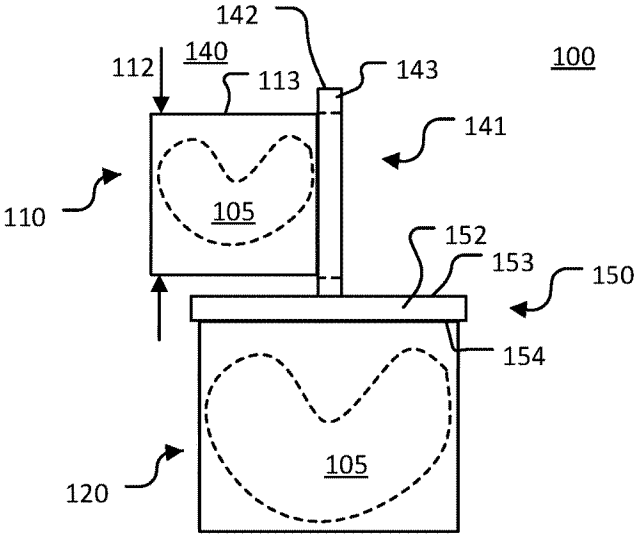

Referring to FIG. 1A, a block diagram of a toy storage apparatus 140 is shown. Referring also to FIG. 1B, a block diagram of a toy system 100 that includes the storage apparatus 140 is shown. FIGS. 1C and 1D are side views of the storage apparatus 140 and the toy system 100, respectively. The view shown in FIG. 1C is rotated 90 degrees (°) about the z axis compared to the view of FIG. 1A. The view shown in FIG. 1D is rotates 90 degrees (°) about the z axis compared to the view of FIG. 1A. In FIGS. 1A and 1B, the x axis is out of the page. In FIGS. 1C and 1D, the y axis is into the page.

The storage apparatus 140 holds a first canister 110 and a second canister 120. When held by the storage apparatus 140, the first canister 110 and the second canister 120 extend along different directions. In the example of in FIGS. 1B and 1D, the first canister 110 extends along the x direction when held by the storage apparatus 140, and the second canister 120 extends along the z direction when held by the storage apparatus 140.

The canisters 110 and 120 are configured to hold a moldable material 105. The moldable material 105 is any pliable and shapeable material. The moldable material 105 may be, for example, putty, clay, and/or a dough substance (for example, PLAY-DOH®, available from Hasbro, Inc. of Pawtucket, Rhode Island). In FIGS. 1B and 1D, the moldable material 105 is contained within the canisters 110 and 120 and is represented with a dashed line style. The canisters 110 and 120 may be identical to each other or different from each other. In the example shown in FIGS. 1B and 1D, the canister 110 is smaller than the canister 120 and is configured to hold a smaller volume of the moldable material 105. The canister 120 being larger and able to hold more of the moldable material 105 (thus making the loaded canister 120 heavier than the loaded canister 110) may enhance the ability of the storage apparatus 140 to hold the canister 110 along the first direction.

The storage apparatus 140 includes a first storage component 141 that holds the first canister 110, and a second storage component 150 that holds the second canister 120. The first storage component 141 holds the canister 110 temporarily, for example, with a friction fit. The second storage component 150 holds the second canister 120 temporarily, for example, with a friction fit.

The first storage component 141 includes a structure 142 that defines an opening 144. The opening 144 passes through the structure 142 in the x direction. The opening 144 is sized to receive and hold the first canister 110. For example, the opening 144 may have circular shape in the y-z plane and may have a diameter that is slightly larger than a cross-sectional diameter 112 of a sidewall 113 of the canister 110. In these implementations, a wall 143 that defines the opening 144 makes physical contact with the sidewall 113. A frictional engagement arises between the wall 143 and the sidewall 113 such that the first canister 110 is held in the opening 144.

Figures 2A, 2B, 2C, 2D:
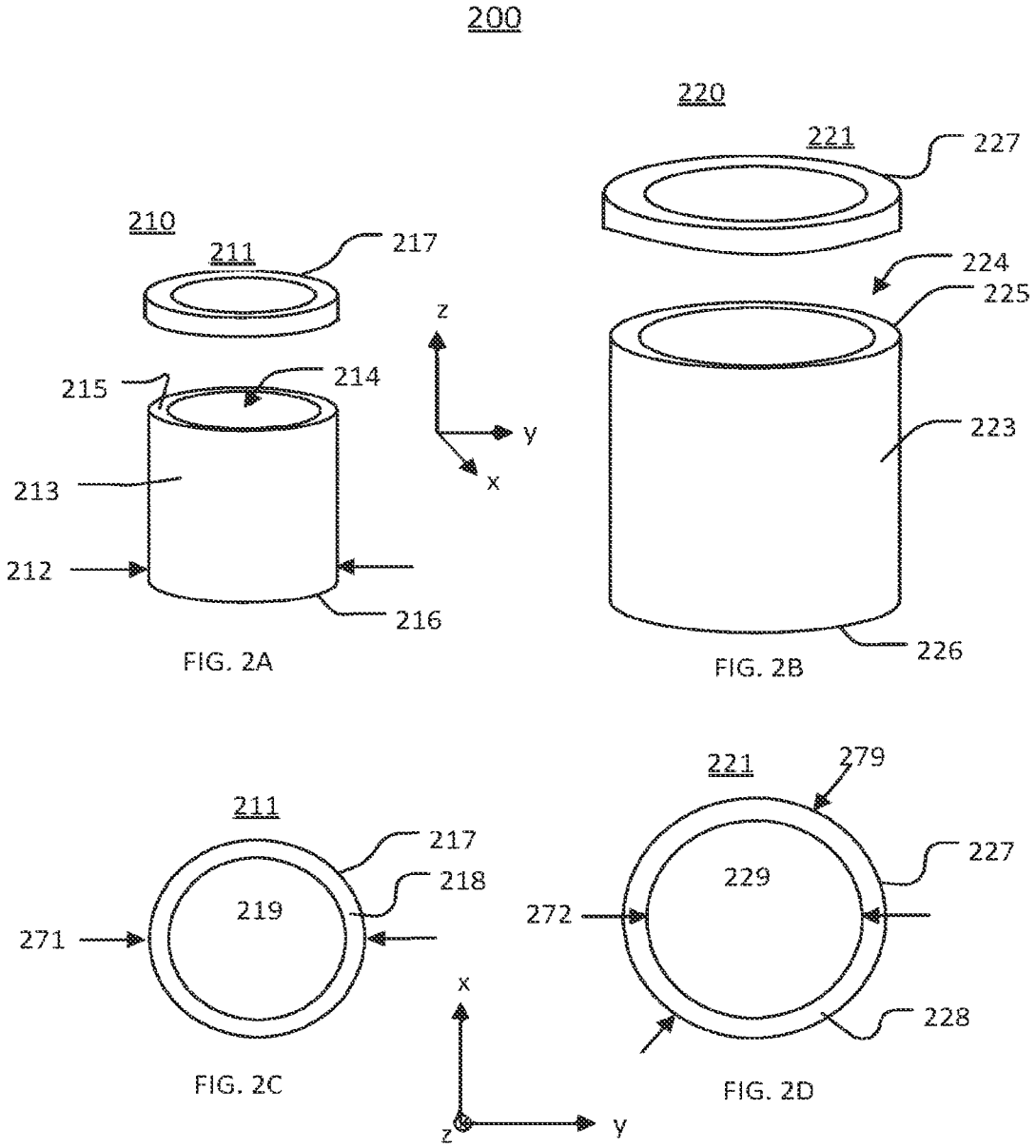
FIG. 2A is a perspective view of a canister.
FIG. 2B is a perspective view of another canister.
FIG. 2C is a top view of a lid for the canister of FIG. 2A.
FIG. 2D is a top view of a lid for the canister of FIG. 2D.

The second storage component 150 includes a base portion 152. The base portion 152 includes a first side 153, a second side 154 opposite the first side 153, and an interface 155 on the second side 154. The base portion 152 extends along a direction that is different from a direction along which the opening 144 extends. In the example of FIGS. 1A and 1B, the opening 144 extends in the y-z plane, and the base portion 152, the first side 153, and the second side 154 extend in the x-y plane. The interface 155 is any type of interface that is capable of holding the second canister 120. For example, the interface 155 may be a flange that is configured to fit into a recess of a lid of the second canister 120. An example of such an implementation is shown in FIGS. 2E and 2G. In other implementations, the interface 155 is a flange or other structure that is configured to fit around and make physical contact with a perimeter of a lid (such as the perimeter 227 of FIG. 2B), a perimeter of a design region that extends from the lid (such as the design region 475 of FIGS. 4A-4C), or a body of the second canister 120 (such as a sidewall 123 or the sidewall 223 of FIG. 2B) such that the flange holds the lid, a portion of the lid, or the canister body in a frictional engagement.

The storage apparatus 140 is rigid and may be made from, for example, molded plastic, metal, or a hardened polymer material. The first storage component 141 and the second storage component 150 may be formed as a unitary piece. For example, the storage apparatus 140 may be formed from a single mold.

FIGS. 2A-2G relate to a toy system 200. The toy system 200 is an example of an implementation of the toy system 100. The toy system 200 includes a first canister 210, a second canister 220, and a storage apparatus 240 that is configured to hold the first canister 210 and the second canister 220.

FIG. 2A is an exploded perspective view of the canister 210. FIG. 2B is an exploded view of the canister 220. FIG. 2C is a top view of a lid 211 that attaches to the canister 210. FIG. 2D is a top view of a lid 221 that attaches to the canister 220. FIG. 2E is a front view of the storage apparatus 240, and FIG. 2F is a side view of the storage apparatus 240. The view of the storage apparatus 240 shown in FIG. 2F is rotated 90° about the z axis compared to the view of the storage apparatus 240 shown in FIG. 2E. FIG. 2G is a bottom view of the storage apparatus 240.

The canister 210 includes a sidewall 213 that defines an interior space 214. The sidewall 213 is generally cylindrical and extends in the z direction from a second end 216 to a first end 215. The second end 216 is closed such that the interior space 214 is only open at the first end 215. In the example of FIG. 2A, the sidewall 213 extends along the z direction from the second end 216 to the first end 215 such that the sidewall 213 has a substantially constant diameter 212 in the x-y plane. Other implementations are possible. For example, the diameter 212 of the sidewall 213 may increase along the z direction. In some implementations, the canister 210 and/or the canister 220 have a slight taper at or near the second end 216.

The lid 211 fits onto the first end 215 and covers the first end 215. The lid 211 is configured to be repeatedly attached to and removed from the first end 215 without damaging the lid 211 or the first end 215. When the lid 211 is on the first end 215, the interior space 214 is enclosed.

The lid 211 has a perimeter 217 and a diameter 271. The perimeter 217 is the same shape as the sidewall 213 in the x-y plane. In the implementation shown in FIGS. 2A and 2C, the lid 211 includes a lip 218 that defines a recessed region 219. The lip 218 follows the perimeter 217 of the lid 211, and the recessed region 219 is surrounded by the lip 218. The diameter 271 is slightly larger than the diameter 212 such that the lip 218 fits over the first end 215. The lip 218 receives the first end 215 to attach the lid 211 to the sidewall 213. When the lid 211 is on the first end 215, the recessed region extends in the x-y plane parallel to the second end 216 and has a circular shape in the x-y plane.

The canister 220 is similar to the canister 210, but has different dimensions than the canister 210 in the x, y, and z directions. The canister 220 includes a sidewall 223 that is generally cylindrical and extends in the z direction from a second end 226 to a first end 225. In some implementations, the canister 210 and/or the canister 220 are tapered at or near the second end 226. The second end 226 is closed. The second end 226 and the sidewall 223 define an interior space 224. The lid 221 is configured to be repeatedly attached to and removed from the end 225 without damaging the lid 221 or the end 225. When the lid 221 is on the first end 225, the lip 228 receives the first end 225 and the interior space 224 is enclosed. The lid 221 has a perimeter 227 that is the same shape as the sidewall 223 in the x-y plane. The lid 221 includes a lip 228 that surrounds a recessed region 219. The recessed region 219 has a circular cross-section and a diameter 272 in the x-y plane. The lid 221 has a diameter 279. The diameter 279 may be the same as the diameter 271 or the diameter 279 may be smaller or larger than the diameter 271.

The canisters 210 and 220 may be identical or different sizes (such as the implementation shown in FIGS. 2A and 2C). In implementations in which the canisters 210 and 220 are different sizes, the interior spaces 214 and 224 are different volumes. For example, the extent of the interior space 214 in the z direction is smaller than the extent of the interior space 224 in the z direction and the diameter of the interior space 214 is smaller in the x-y plane than the diameter of the interior space 224 in the x-y plane. Other configurations are possible. For example, in some implementations, the diameter of the interior space 214 is the same as the diameter of the interior space 224 in the x-y plane and the extents of the interior spaces 214 and 224 are different such that the interior spaces have different volumes but the same diameter. In these implementations, the lids 221 and 212 may be identical and interchangeable such that either lid 212, 221 may be used on either canister 210, 220. In yet other implementations, the canisters 210 and 220 are identical to each other and the lids 221 and 212 are identical to each other.

Referring also to FIGS. 2E-2G, the storage apparatus 240 includes a first storage portion 241 and a second storage portion 250 that are connected to each other by a pedestal portion 260. The pedestal portion 260 extends in the z direction.

The first storage portion 241 is configured to hold the first canister 210. The second storage portion 250 is configured to hold the second canister 220. The first storage portion 241 includes a ring 242 that includes an inner wall 243. The inner wall 243 defines an opening 244. The opening 244 is circular in the y-z plane and passes through the first storage portion 241 in the x direction. The opening 244 has a diameter 245 in the y-z plane. The diameter 245 is slightly larger than the diameter 212 such that the sidewall 213 fits in the opening 244 and the inner wall 243 holds the sidewall 213 in frictional engagement. In this way, the first storage portion 241 holds the first canister 210. In some implementations, the opening 244 has a diameter that is slightly larger than the diameter 271. In these implementations, the inner wall 243 makes physical contact with the perimeter 217 of the lid 211 and a frictional engagement arises between the perimeter 217 of the lid 211 and the inner wall 243 such that the first storage portion 241 holds the first canister 210 at the lid 211.

The second storage portion 250 is configured to hold the second canister 220. The second storage portion 250 includes a base portion 252, which has a first side 253 and a second side 254 that is opposite the first side 253. The first side 253 faces the first storage portion 241. The base portion 252 has a circular shape and a diameter 258 in the x-y plane. An interface 255 extends from the second side 254 along the −z direction. In the implementation shown in FIGS. 2E-2G, the interface 255 is a rigid flange or ring-shaped rigid wall structure that has a circular shape and a diameter 259 in the x-y plane. The diameter 259 is slightly smaller than the diameter 272 such that interface 255 fits in the recess 229 and a frictional engagement arises between the interface 255 and the lip 228. In this way, the second storage portion 250 holds the second canister 220.

The second storage portion 250 also includes a rigid projection 257. The rigid projection 257 may have any shape. For example, the rigid projection 257 may be an arbitrary shape (such as shown in FIG. 2G), an animal, a vehicle, a robot, or a character. The rigid projection 257 is surrounded by the interface 255. The rigid projection 257 extends from the second side 254 in the −z direction. The interface 255 extends further in the −z direction than the rigid projection 257. Thus, the rigid projection 257 is not visible in the side views of FIGS. 2E and 2F.

The configuration of the base portion 252 allows the second storage portion 250 to be used to imprint a design onto the moldable material 105 and/or form a design element from the moldable material 105. To imprint a design onto the moldable material 105, the user prepares the moldable material 105 by, for example, rolling or flattening the moldable material 105 in the x-y plane on a rigid surface (such as a table). The user holds the storage apparatus 240 and places the interface 255 onto the prepared moldable material 105. The user applies pressure to the storage apparatus 240 in the −z direction until the interface 255 meets the rigid surface. When the interface 255 meets the rigid surface, the moldable material 105 is cut in the shape of the interface 255 (the circular flange in this example). Additionally, the rigid projection 257 imparts a design onto the moldable material 105 without cutting through or separating the moldable material 105.

Figure 3B:
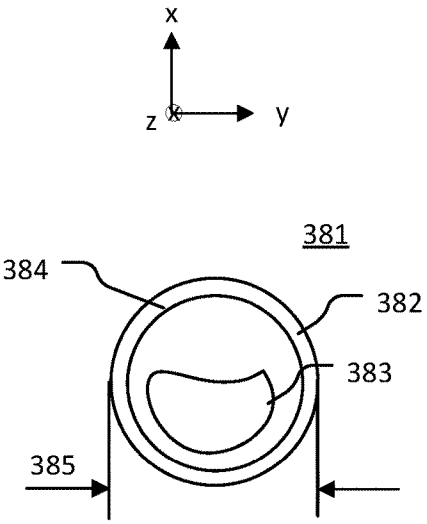
FIG. 3B is a bottom view of a creation block.
Figure 3A:
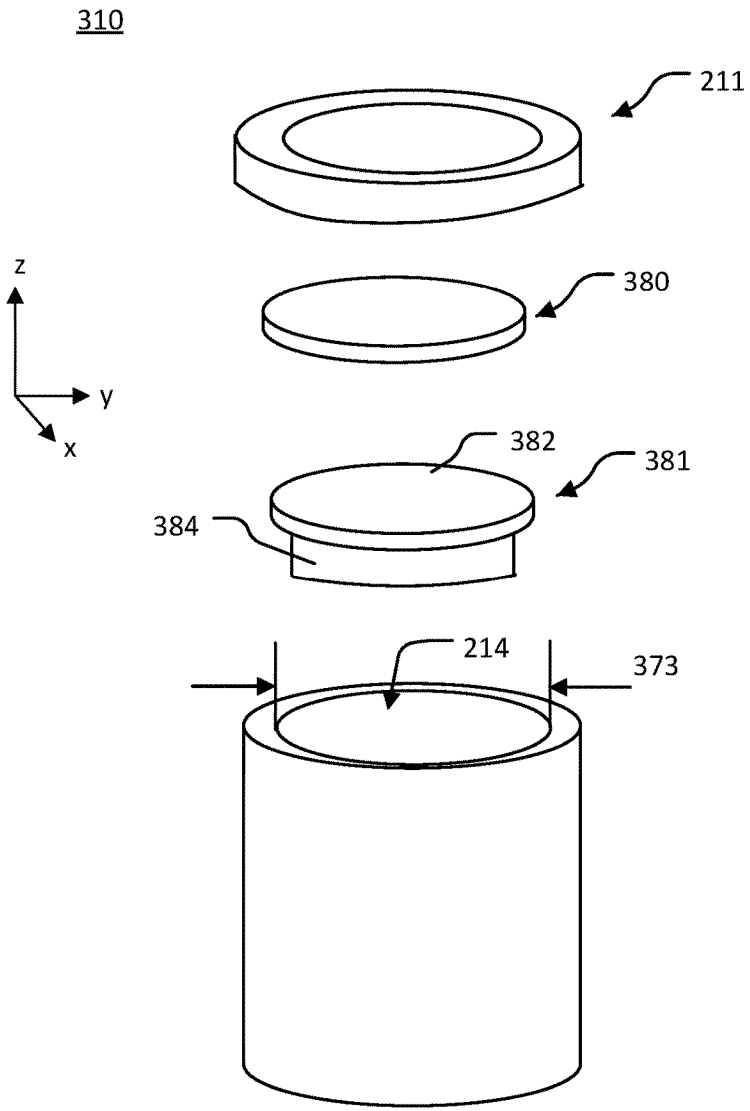
FIG. 3A is an exploded view of another canister.

Referring to FIGS. 3A and 3B, perspective and top views, respectively, of a canister 310 are shown. The canister 310 may be used with the storage apparatus 140 or 240. For example, the canister 310 may be held by the first storage portion 241. The canister 310 is the same as the canister 210 (FIGS. 2A and 2C), except the canister 310 includes a design element 380 and a creation block 381. The design element 380 and the creation block 381 fit inside the interior space 214.

The design element 380 is pre-formed. For example, the design element 380 may be produced concurrently with the storage apparatus 140 or 240 and packaged with the storage apparatus 140 or 240. The design element 380 may be made of any type of material that is capable of maintaining the pre-formed shape. The design element 380 may be rigid or flexible. Moreover, the design element 380 may be made of a material that is shapeable by the user. For example, the design element 380 may be made of the moldable material 105. Thus, the design element 380 may be a re-usable item that may be shaped into a different object and enhances the play value of a play set that includes the storage apparatus 140 or 240. Moreover, the design element 380 may be sized to fit into the opening 244. Thus, in some implementations, the opening 244 is configured to hold the design element 380 or a canister (such as the first canister 210 or the canister 310). This adds additional options for using a toy set that includes the storage apparatus 240 and further increases the play value of a toy set that includes the storage apparatus 240.

The creation block 381 includes a base 382 and a flange 384 that extends in the −z direction from the base 382. The base 382 has a circular shape and a diameter 385 in the x-y plane. The diameter 385 is smaller than a diameter 373 of the interior space 214 such that the creation block 381 fits into the interior space 214. The creation block 381 also includes a design projection 383 that extends from the base 382 in the −z direction. The flange 384 extends further in the −z direction from the base 382 than the flange 384. The flange 384 and the design projection 383 are made from a rigid material that is capable of cutting and/or imprinting the moldable material 105.

Figure 4C:
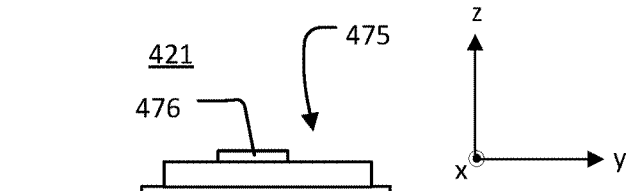
FIG. 4C is a top view of the lid of FIG. 4B.
Figure 4B:
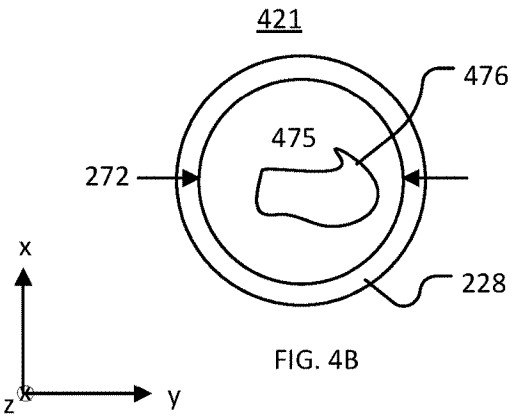
FIG. 4B is a side view of a lid for the canister of FIG. 4A.
Figure 4A:
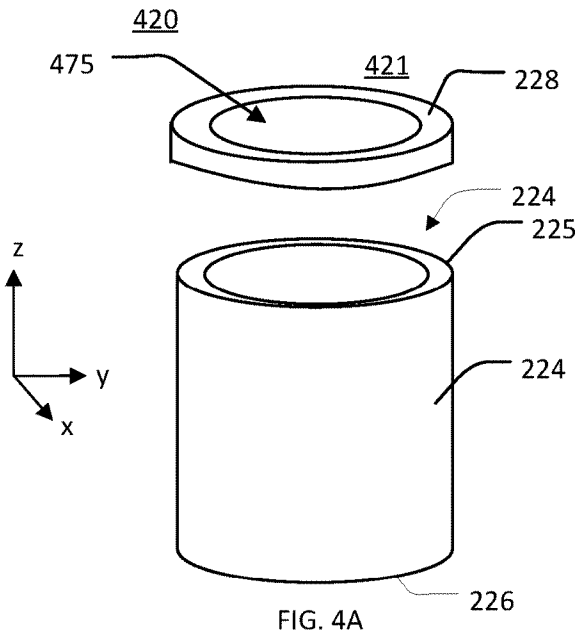
FIG. 4A is a perspective view of another canister.

FIGS. 4A-4C are perspective, top, and side views of a lid 421, respectively. In the example of FIGS. 4A-4C, the lid 421 is used in place of the lid 221 (FIGS. 2B and 2D) as part of a canister 420. Like the lid 221, the lid 421 includes the lip 228, which fits onto the end 225 to enclose the interior space 224. Instead of surrounding the recess 229, in the lid 421, the lip 228 surrounds a design region 475. The design region 475 extends along the z direction further than the lip 228 extends along the z direction. Thus, as shown in FIG. 4C, the design region 475 is raised compared to the lip 228. The design region 475 includes a projection 476, which extends in the z direction from the design region 475. The design region 475 is substantially flat in the x-y plane. The projection 476 is rigid and is configured to make an imprint or indentation in a moldable material. The projection 476 may have any shape. For example, the projection 476 may be shaped as an animal, a robot, a plant, or a car.

The implementations discussed above and other implementations are within the scope of the claims. For example, the storage apparatus 140 or the storage apparatus 240 may be packaged as a toy set that includes one or more canisters such as the canisters 210 and 220 (FIGS. 2A and 2B) and more than one design element such as the design element 380 (FIG. 3A).

The canisters 110, 120 may be identical. The storage apparatus 140 may be configured to hold either the canister 110 or the canister 120. The storage apparatus 150 may be configured to hold either the canister 110 or the canister 120.

The pedestal portion 260 and the rigid projection 257 may have a common design theme. For example, the pedestal portion 260 and the rigid projection 257 may both be shaped as a particular animal or character. Moreover, the storage apparatus 240 may be packaged with one or more design elements 380 that also have the design theme.

The creation block 381 and/or the design element 380 may be enclosed in the first canister 210 and/or the second canister 220.

What is claimed is:

1. A toy set comprising:

a first canister configured to hold a first amount of moldable material;

a second canister configured to hold a second amount of moldable material;

one or more pre-formed design elements; and a storage apparatus configured to hold the first canister and the second canister, the storage apparatus comprising:

a first storage component comprising a structure that defines an opening that extends in a first direction, the structure being configured to hold one of the at least one pre-formed design elements or the first canister in the opening; and a second storage component comprising a base portion that extends along a second direction that is different from the first direction, the base portion comprising an interface configured to hold the second canister, wherein the base portion further comprises a rigid projection that extends from the base portion.

2. The toy set of claim 1, wherein the base portion comprises:

a first side;

a second side opposite the first side; and a flange that extends from the second side, wherein the flange is configured to hold the second canister.

3. The toy set of claim 2, further comprising a second lid configured to attach to the second canister, the second lid comprising a recessed region, and wherein the flange is configured to fit into a recess of the second lid.

4. The toy set of claim 1, wherein the first amount of moldable material is different from the second amount of moldable material.

5. The toy set of claim 4, wherein the first direction is perpendicular to the second direction.

6. The toy set of claim 1, further comprising:

a first lid configured to attach to the first canister; and a second lid configured to attach to the second canister, wherein the first lid has a first diameter, and the second lid has a second diameter that is different from the first diameter.

7. The toy set of claim 1, further comprising a first lid configured to attach to the first canister, wherein the opening of the first storage component holds the first canister at a perimeter of the first lid.

8. The toy set of claim 1, wherein the rigid projection is surrounded by the interface.

9. The toy set of claim 8, wherein the interface comprises a flange, the flange extends in the first direction to a first distance from the first side of the base portion, the projection extends in the first direction to a second distance from the first side of the base portion, the second distance being less than the first distance such that, when the first side of the base portion is pressed into the moldable material, an imprinted element having substantially the same size as a region defined by the flange and a design that corresponds to the projection is formed.

10. The toy set of claim 1, wherein the opening is a circular opening.

11. The toy set of claim 1, further comprising a creation block comprising a design projection extending from the first block side.

12. The toy set of claim 11, wherein the creation block is configured to fit in the first canister.

13. The toy set of claim 1, wherein the first direction is perpendicular to the second direction, the first canister extends along the second direction when the first canister is held by the structure, and the second canister extends along the first direction when the interface holds the second canister.

14. The toy set of claim 1, wherein the storage apparatus further comprises a pedestal portion that extends in the first direction, the pedestal portion being connected to the first storage component and the second storage component.

15. The toy set of claim 14, wherein the first storage component, the second storage component, and the pedestal portion are a single piece of molded plastic.

16. The toy set of claim 1, further comprising:

a first lid configured to attach to the first canister; and a second lid configured to attach to the second canister, and wherein one or more of the first lid and the second lid comprises a design projection.

17. The toy set of claim 1, wherein the design element comprises the moldable material.

18. A toy storage apparatus comprising:

a first storage component comprising a structure that defines an opening that extends in a first direction, the structure being configured to hold a first canister at the opening, the first canister being configured to contain a moldable material; and a second storage component comprising a base portion that extends along a second direction that is different from the first direction, the base portion comprising an interface configured to hold a second canister, the toy storage apparatus further comprising a pedestal portion that extends in the first direction, the pedestal portion being connected to the first storage component and the second storage component.

19. The toy storage apparatus of claim 18, wherein the interface comprises a flange, and the flange is configured to hold the second canister.

20. The toy storage apparatus of claim 18, further comprising a design projection that extends from the base portion.

21. The toy set of claim 18, further comprising one or more pre-formed design elements configured to fit into the opening.

22. The toy set of claim 21, wherein the pre-formed design elements comprise the moldable material.

23. The toy set of claim 21, further comprising a creation block configured to fit into an interior of the first canister, the creation block comprising a design projection configured to impart a design onto the moldable material.

24. A toy storage apparatus comprising:

a first storage component comprising a structure that defines an opening that extends in a first direction, the structure being configured to hold a first canister at the opening, the first canister being configured to contain a moldable material;

a second storage component comprising a base portion that extends along a second direction that is different from the first direction, the base portion comprising an interface configured to hold a second canister; and a design projection that extends from the base portion.

25. The toy set of claim 24, wherein the base portion further comprises a rigid projection that extends from the base portion.

26. The toy storage apparatus of claim 24, wherein the first direction is perpendicular to the second direction, the first canister extends along the second direction when the first canister is held by the structure, and the second canister extends along the first direction when the interface holds the second canister.

* * * * *